US007013667B2

(12) United States Patent
Jung

(10) Patent No.: US 7,013,667 B2
(45) Date of Patent: Mar. 21, 2006

(54) DISPENSER FOR REFRIGERATOR

(75) Inventor: Jae Wook Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/799,679

(22) Filed: Mar. 15, 2004

(65) Prior Publication Data

US 2004/0182103 A1 Sep. 23, 2004

(30) Foreign Application Priority Data

Mar. 19, 2003 (KR) ..... 10-2003-0017081

(51) Int. Cl.
*B67D 5/62* (2006.01)

(52) U.S. Cl. ..... 62/389; 222/146.6

(58) Field of Classification Search ..... 62/389, 62/285, 288, 291; 222/153.09, 108, 146.6
See application file for complete search history.

(56) References Cited

U.S. PATENT DOCUMENTS

| | | | | | |
|---|---|---|---|---|---|
| 5,474,213 | A | * | 12/1995 | Unger | 222/108 |
| D367,659 | S | * | 3/1996 | Baker et al. | 172/797 |
| 5,683,015 | A | * | 11/1997 | Lee | 222/146.6 |
| 5,886,430 | A | * | 3/1999 | Ralson et al. | 307/126 |
| 6,039,219 | A | * | 3/2000 | Bach et al. | 222/160 |
| 6,131,812 | A | * | 10/2000 | Schneider | 235/385 |
| 6,158,564 | A | * | 12/2000 | Derelanko | 193/2 R |
| 6,260,362 | B1 | * | 7/2001 | Choi | 62/89 |
| 6,425,425 | B1 | * | 7/2002 | Bianchi et al. | 141/362 |
| 6,474,094 | B1 | * | 11/2002 | Kim | 62/441 |
| 6,595,021 | B1 | * | 7/2003 | Skinner | 62/344 |
| 6,651,449 | B1 | * | 11/2003 | Heims et al. | 62/98 |
| 6,658,887 | B1 | * | 12/2003 | Lee et al. | 62/389 |
| 6,679,082 | B1 | * | 1/2004 | Tunzi | 62/344 |
| 6,708,506 | B1 | * | 3/2004 | Lee | 62/125 |

FOREIGN PATENT DOCUMENTS

| | | | | |
|---|---|---|---|---|
| EP | 0371267 | A1 | * | 6/1990 |
| EP | 0780644 | A2 | * | 6/1997 |
| EP | 0780644 | A3 | | 1/1998 |
| GB | 2246195 | A | * | 1/1992 |
| GB | 2198512 | A | | 6/1998 |
| JP | 08256914 | A | * | 10/1996 |
| JP | 10327763 | A | | 12/1998 |

* cited by examiner

*Primary Examiner*—Mohammad M. Ali
(74) *Attorney, Agent, or Firm*—Fleshner & Kim, LLP

(57) ABSTRACT

A dispenser for a refrigerator is provided which allows for more storage space inside the refrigerator, and which includes a locking mechanism which allows a drain pan of the dispenser to be removably attached. The dispenser includes a housing mounted on a front surface of a refrigerator door, a supply pipe installed at an upper portion of the housing, a drain pan detachably disposed at a lower portion of the housing, and a locking unit formed between the drain pan and the housing which removably attaches the drain pan to the dispenser housing. The locking unit prevents unwanted separation of the drain pan from the dispenser, and the dispenser's reduced size allows for more storage space in the refrigerator.

13 Claims, 5 Drawing Sheets

DISPENSER FOR REFRIGERATOR

BACKGROUND OF THE INVENTION

1. Field of the Invention

The present invention relates to a dispenser of a refrigerator and, more particularly, to a dispenser for a refrigerator capable of preventing loss of a drain pan and widening a storage space inside the refrigerator by reducing the size of the dispenser.

2. Description of the Background Art

The latest version of refrigerators is equipped with a dispenser which allows users to take water or ice kept in a refrigerator without a necessity of opening a refrigerator door. Accordingly, with such a dispenser, leakage of cooling air inside the refrigerator can be prevented and users' convenience can be increased.

FIG. 1 is a perspective view of a refrigerator having a dispenser in accordance with a conventional art.

As shown in FIG. 1, the conventional refrigerator includes a refrigerator body 102 having a refrigerating chamber (not shown) and a freezing chamber (not shown) therein, a refrigerating chamber door 104 for opening and closing the refrigerating chamber, a freezing chamber door 106 for opening and closing the freezing chamber, and a dispenser 108 installed at the refrigerating chamber door 104 and providing water or ice kept in the refrigerating chamber without a necessity of opening the refrigerating chamber door 104.

As shown in FIG. 2, the dispenser 108 includes a dispenser case 110 mounted at an outer surface of the refrigerating chamber door 104 and having a receiving space 112 for placing a cup therein, a water supply pipe 114 disposed at an upper surface of the dispenser housing 110 and supplying water or ice, an operation lever 116 disposed at a rear side of the dispenser housing 110 and opening and closing the water supply pipe 114 according to user's manipulation, and a drain pan 120 detachably mounted at a lower surface of the dispenser housing 110 and collect water leaked from the water supply pipe 114.

A mounting unit 124 is formed at a lower side of the dispenser housing 110, on which the drain pan 120 is mounted.

The water supply pipe 114 is connected to a water container (not shown) disposed inside the refrigerating chamber (not shown) by a water supply pipe 122, and opened and closed according to an operation of the operation lever 116 to supply water into the cup inserted in the dispenser housing 110.

The drain pan 120 is detachably mounted on the mounting unit 124 formed at the lower side of the dispenser housing 110, and a pan cover 128 having a plurality of holes 126 through which leaked water is to flow is mounted at an upper surface of the drain pan 120.

The conventional dispenser 108 for a refrigerator constructed as described above operates as follows.

When the cup is put into the receiving space 112 of the dispenser housing 110, the operation lever 116 operates to open the water supply pipe 114. Then, water is supplied into the cup through the water supply pipe 114. When the cup is taken out from the dispenser housing 110, the operation lever 116 returns to the original state to close the water supply pipe 114. At this time, water failing to be supplied to the cup from the water supply pipe 114 is collected into the drain pan 120, thereby preventing leaked water from flowing down on the refrigerator.

When the drain pan 120 is filled with water, a user lifts up the drain pan 120 in the direction of 'T' indicated by an arrow from the mounting unit 124 of the dispenser housing 110 and then takes it out in the direction of 'S' indicated by an arrow.

However, the conventional dispenser 108 of the refrigerator constructed as described above has the following problems.

That is, for example, since the drain pan 120 is disposed in a manner of being simply put in the dispenser housing 110 rather than being locked at the lower portion of the dispenser housing 110, if the refrigerator is moved or used for a long period, the drain pan 120 may be separated from the dispenser housing 110, and accordingly, the drain pan 120 may be lost in some cases.

In addition, when the drain pan is separated from the dispenser housing, it needs to be lifted up in the direction of 'T' and then taken out in the direction of 'S', so it is difficult to separate the drain pan and water filled in the drain pan can be poured over in the course of separation of the drain pan from the dispenser housing 110.

Moreover, since a certain space is required to mount the drain pan in the dispenser housing, the dispenser housing is to widen, and accordingly, since the space taken by the dispenser housing is increased, the storage space inside the refrigerating chamber becomes relatively narrow.

SUMMARY OF THE INVENTION

Therefore, one object of the present invention is to provide a dispenser for a refrigerator capable of preventing loss of a drain pan and easily separating the drain pan by locking a drain pan.

Another object of the present invention is to provide a dispenser for a refrigerator capable of increasing an internal space of a refrigerator by minimizing the width for insertion of a dispenser into the inner side of a refrigerator door.

To achieve these and other advantages and in accordance with the purpose of the present invention, as embodied and broadly described herein, there is provided a dispenser for a refrigerator including: a dispenser housing mounted on a front surface of a refrigerator door; a supply pipe mounted at an upper surface of the dispenser housing and supplying water therethrough; and a drain pan detachably disposed at a lower surface of the dispenser and collecting water dropped from the supply pipe, wherein a locking unit for locking the drain pan to the dispenser housing is formed between the drain pan and the dispenser housing.

A inserting part on which the drain pan is mounted is formed at a lower portion of the dispenser housing, and when the drain is mounted on the inserting part, the front surface of the drain pan is level with the front surface of the refrigerator door.

The locking unit includes a locking groove formed at a rear surface of the dispenser housing and a locking hook formed at a rear surface of the drain pan and engaged to the locking groove.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There can be several embodiments for a dispenser of a refrigerator in accordance with the present invention, of which the most preferred one will now be described.

Figure 1:
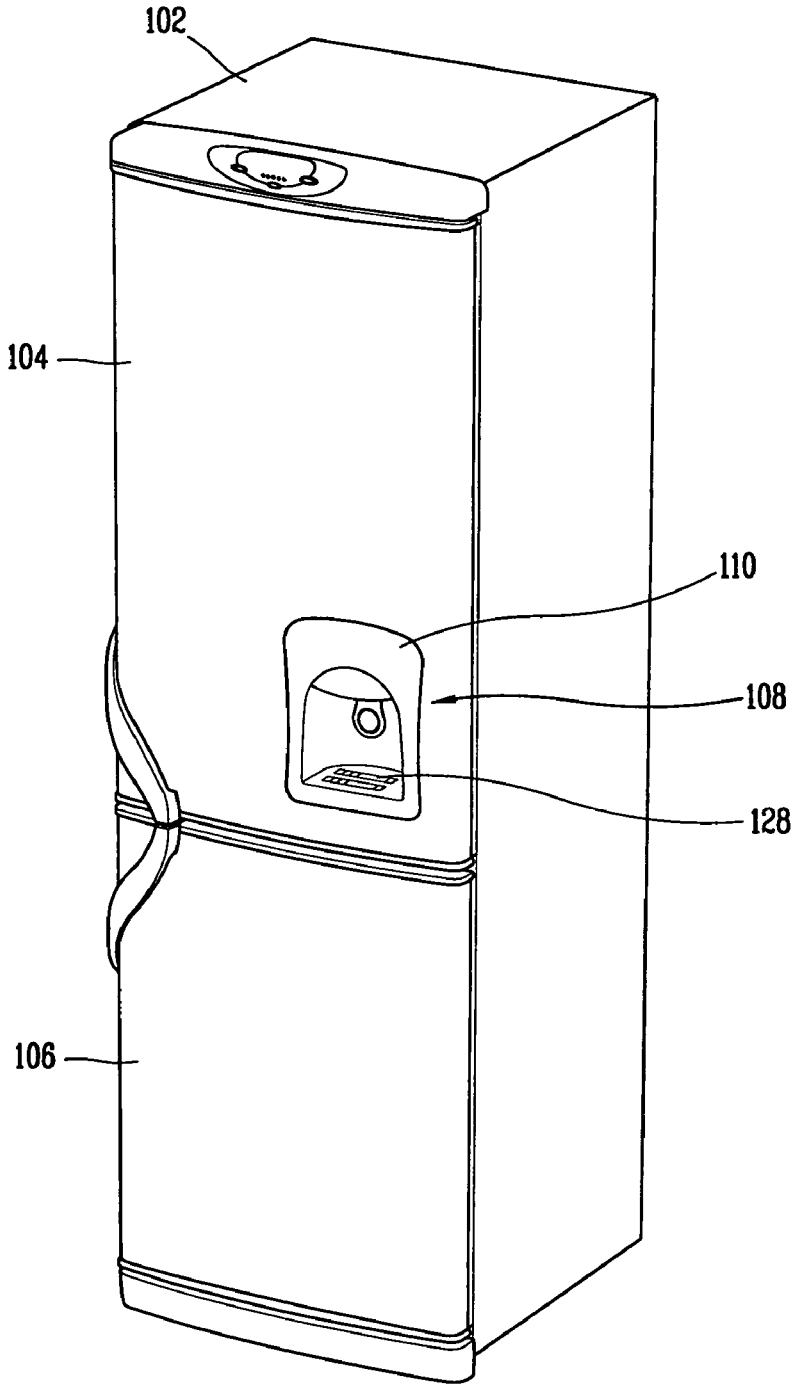
FIG. 1 CONVENTIONAL ART
FIG. 1 is a perspective view of a refrigerator having a dispenser in accordance with a conventional art.
Figure 2:
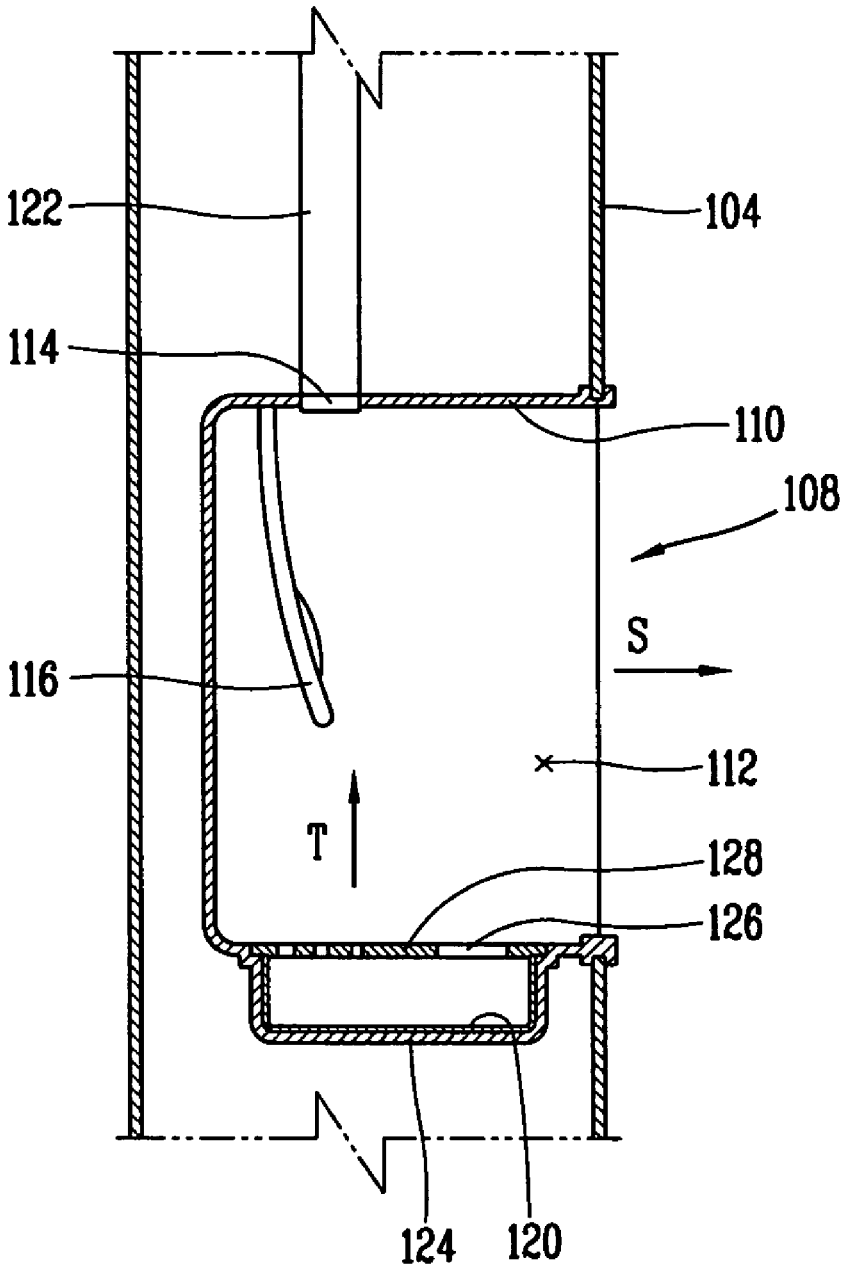
FIG. 2 CONVENTIONAL ART
FIG. 2 is a sectional view showing a dispenser of a refrigerator in accordance with the conventional art.
Figure 3:
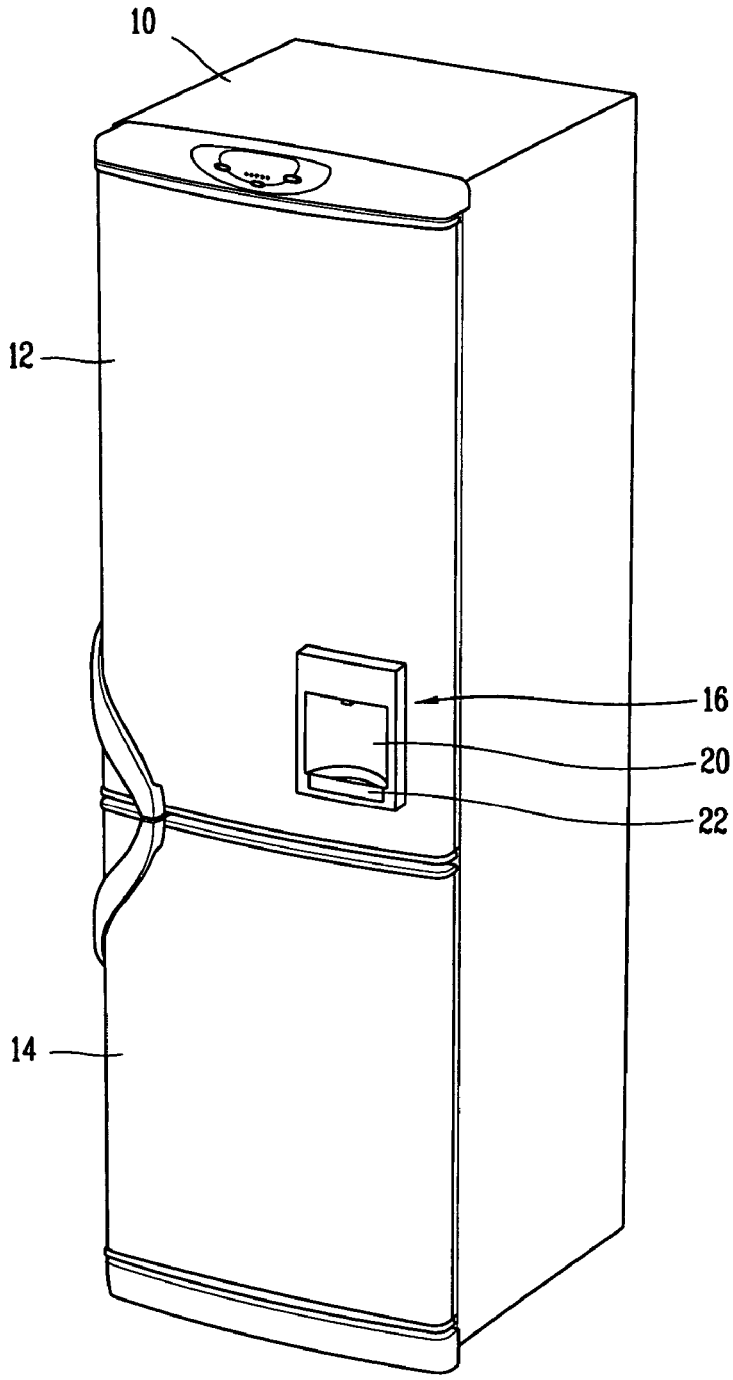
FIG. 3 is a perspective view of a refrigerator having a dispenser in accordance with the present invention.

FIG. 3 is a perspective view of a refrigerator having a dispenser in accordance with the present invention.

A refrigerator in accordance with the present invention includes a refrigerator body 10 having a refrigerating chamber (not shown) for keeping refrigerated food items and provided at an upper portion and a freezing chamber (not shown) for keeping frozen food items and provided at a lower portion, a refrigerating chamber door 12 mounted at a front side of the refrigerating chamber and opened and closed, a freezing chamber door 14 mounted at a front side of the freezing chamber and opened and closed, and a dispenser 16 mounted at the refrigerating door 12 and supplying water or ice kept in the refrigerating chamber to a user without a necessity of opening the refrigerating chamber door 12.

Figure 4:
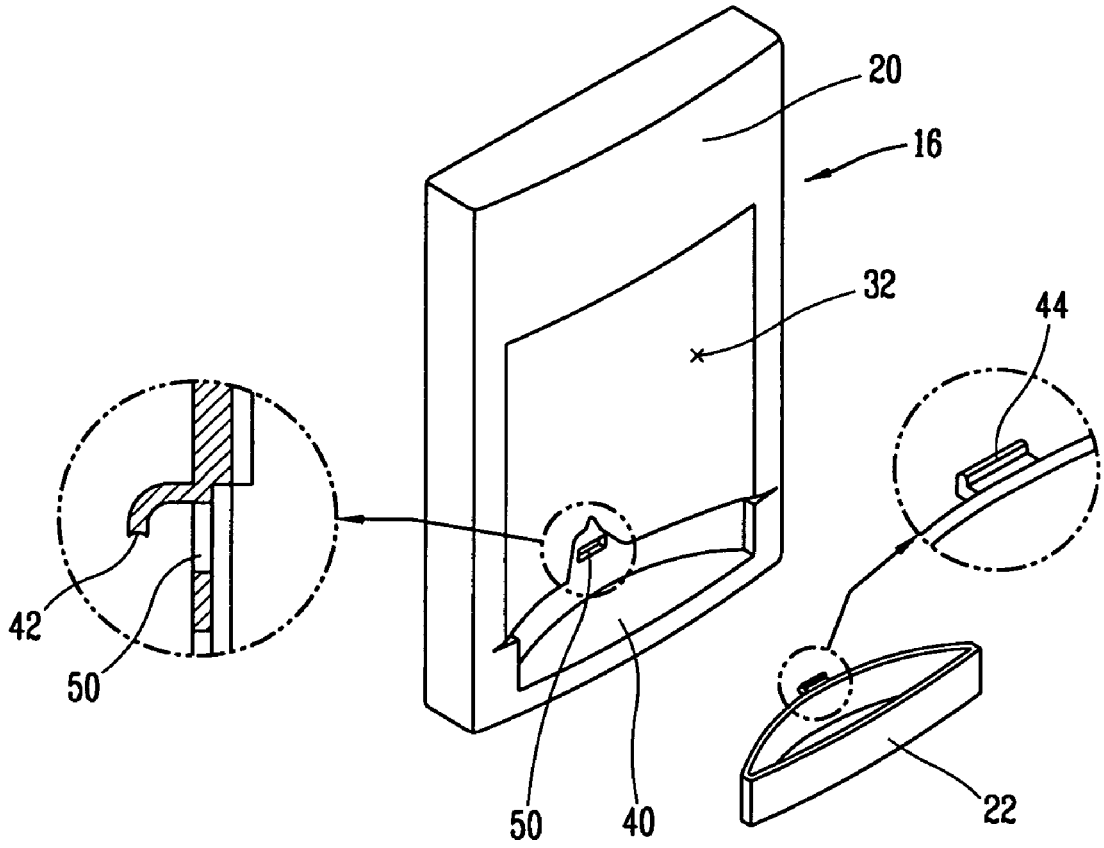
FIG. 4 is an exploded perspective view of the dispenser of the refrigerator in accordance with the present invention.
Figure 5:
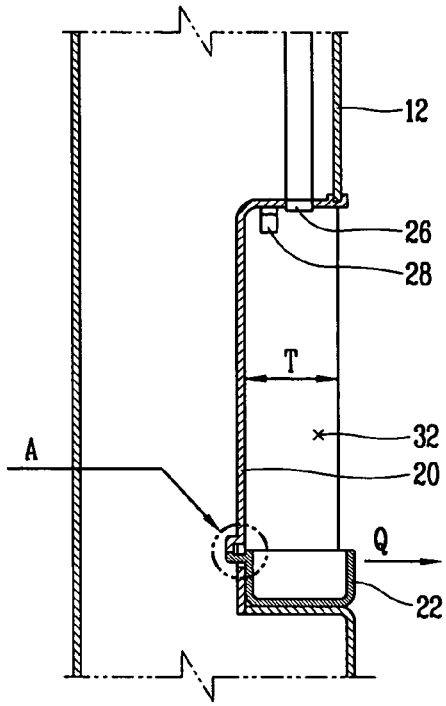
FIG. 5 is a sectional view of the dispenser of a refrigerator in accordance with the present invention.

As shown in FIGS. 4 and 5, the dispenser 16 includes a dispenser housing 20 mounted at a front surface of the refrigerating chamber door 12 and having a certain space, a supply pipe 26 installed at an upper portion of the dispenser housing 20 and supplying water or ice, a switch 28 installed at a rear side of the dispenser housing 20 and opening and closing the supply pipe 26 by a user's manipulation, and a drain pan 22 detachably mounted at a lower portion of the dispenser housing 20 and collecting water leaked from the supply pipe 26.

The dispenser housing 20 is mounted at a front surface of the refrigerating door 20 and having a receiving space 32 in which a cup is inserted.

The drain pan 22 is inserted on the inserting part 40 formed at a lower surface of the dispenser housing 20 and having a storage space for storing water. Locking units 42 and 44 are formed between the drain pan 22 and the dispenser housing 20 to lock the drain pan 22 to the dispenser housing 20.

The inserting part 40 is formed in a semi-circular form at a lower portion of the dispenser housing 20 so as to receive the drain pan 22 thereon, and its front side has an opened form so that the drain pan 22 can be detachably attached in a direction of 'Q' indicated by an arrow.

The front surface of the drain pan 22 and the front surface of the refrigerator door 12 are disposed to define a flat surface in case that the drain pan 22 is inserted on the inserting part 40, so that the width (T) of the dispenser housing 20, namely, the depth of the dispenser housing 20 taken in the refrigerating door 12 can be minimized, and thus, since the space taken by the dispenser housing 20 in the refrigerating chamber can be reduced, the space inside the refrigerating chamber can be increased.

Figure 6:
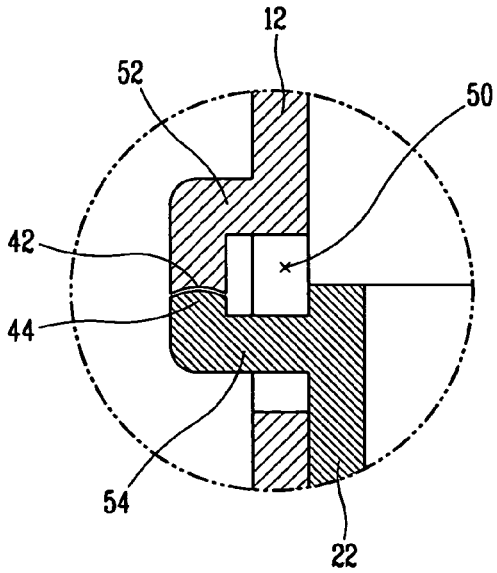
FIG. 6 is an enlarged view of a portion 'A' of FIG. 5.

As shown in FIG. 6, the locking unit includes a locking groove 42 formed at a rear side of the dispenser housing 20 and a locking hook 44 formed at a rear surface of the drain pan 20 and engaged to the locking groove 42.

A through hole 50 is formed at a rear side of the dispenser housing 20. A first support rib 52 extends backward from an upper portion of the through hole 50 and is bent downwardly. The locking groove 42 is formed in a concave form at an end portion of the first support rib 52. The locking hook 44, which protrudes from an end portion of a second support rib 54 extending in a rear direction from a rear portion of the drain pan 22, passes through hole 50.

Preferably, the locking groove 42 has a semi-circular form.

The first support rib 52 has an elastic force by itself and deformed when the locking hook 44 is inserted into the locking groove 42.

The locking hook 44 is protruded with an upper surface in a semi-circular form so as to be inserted into the locking groove 42.

The dispenser for a refrigerator constructed as described above operates as follows.

First, when the user puts the cup into the receiving space 32 of the dispenser housing 20 for water, the switch 28 is turned on to open the supply pipe 26 and water discharged through the supply pipe 26 is supplied into the cup. When the cup is filled with water, the cup is taken out of the dispenser housing 20, and then, the switch 28 is turned off to close the supply pipe 26 to prevent water supply.

Portion of water failing to flow into the cup while being discharged through the supply pipe 26 is stored in the drain pan 22 mounted on the inserting part 40 of the dispenser housing 20.

When the user pulls the drain pan 22 in the direction of 'Q' as the drain pan 22 is filled with water to a certain degree, the locking units 42 and 44 are unlocked and the drain pan 22 is separated from the inserting part 40 of the dispenser housing 20. That is, the locking hook 44 formed at the drain pan 22 is released from the locking groove 42 formed at the dispenser housing 20 by the force of the user's pulling the drain pan 22, thereby releasing the locking.

After the user empties the water of the drain pan 22 and pushes the drain pan 22 on the inserting part 40 of the dispenser housing 20, the locking protrusion 44 is inserted into the locking groove 42, maintaining the drain pan 22 mounted on the inserting part 40 of the dispenser housing 20.

As so far described, the dispenser for a refrigerator in accordance with the present invention has many advantages.

That is, for example, since the locking units 42 and 44 are formed between the drain pan 22 and the dispenser housing 20, when the drain pan 22 is pulled in forwardly by using a certain force, the locking units 42 and 44 are unlocked to separate the drain pan 22, and when the drain pan 22 is pushed into place along the inserting part 40 of the dispenser housing 20 by using a certain force, the locking units 42 and 44 are locked to maintain the drain pan 22 mounted in the dispenser housing 20. Accordingly, the drain pan 22 can be prevented from being separated from the dispenser housing 20 in spite of an external impact or movement of the refrigerator, and thus, loss of the drain pan 22 can be prevented.

In addition, when the drain pan 22 is pulled out in the direction of 'Q' forwardly of the refrigerator door 12, it is separated from the dispenser housing 20, and when the drain pan 22 is pulled in in the opposite direction, it is mounted in the dispenser housing 20. Thus, the drain pan 22 can be easily detached or attached.

Moreover, since the front surface of the drain pan 22 is level with the front surface of the refrigerator door 12, the width (T) of the dispenser housing 20 can be reduced, and thus, since the space taken by the dispenser housing 20 in the refrigerator is reduced, utilization degree of the internal space of the refrigerator can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A dispenser for a refrigerator, comprising:

a dispenser housing mounted on a front surface of a refrigerator door;

a supply pipe provided at an upper portion of the dispenser housing and configured to supply water therethrough;

a drain pan detachably disposed at a lower portion of the dispenser housing and configured to collect water therein; and a locking unit provided between the drain pan and the dispenser housing, wherein the locking unit is configured to secure the drain pan to the dispenser housing when the locking unit is engaged, and to release the drain pan from the dispenser housing when the locking unit is disengaged, wherein the locking unit comprises:

a locking groove formed at a rear portion of the dispenser housing; and a locking hook formed at a rear portion of the drain pan and configured to engage with the locking groove, wherein a through hole formed at a rear portion of the dispenser housing is configured to allow the locking hook to pass therethrough, wherein a first support rib extends back from an upper portion of the through hole and bends downwardly, and wherein the locking groove is formed at an end portion of the first support rib.

2. The dispenser of claim 1, wherein the first support rib and the locking groove are configured to deform in response to a force applied by the locking hook.

3. The dispenser of claim 2, wherein the drain pan is configured to be slildably inserted onto the inserting part and secured into place by the locking unit with a single, substantially horizontal motion, and released by the locking unit and removed from the dispenser housing with a single, substantially horizontal motion.

4. The dispenser of claim 1, wherein the locking groove has a substantially semi-circular form.

5. A refrigerating comprising the dispenser of claim 1.

6. A dispenser for a refrigerator, comprising:

a dispenser housing mounted on a front surface of a refrigerator door; a supply pipe provided at an upper portion of the dispenser housing and configured to supply water therethrough;

a drain pan detachably disposed at a lower portion of the dispenser housing and configured to collect water therein; and a locking unit provided between the drain pan and the dispenser housing, wherein the locking unit is configured to secure the drain pan to the dispenser housing when the locking unit is engaged, and to release the drain pan from the dispenser housing when the locking unit is disengaged, wherein the locking unit comprises:

a locking groove formed at a rear portion of the dispenser housing; and a locking hook formed at a rear portion of the drain pan and configured to engage with the locking groove, wherein the locking hook protrudes from an end portion of a second support rib which extends in a horizontal direction from a rear portion of the drain pan.

7. The dispenser of claim 6, wherein the locking hook comprises a curved protrusion corresponding to the locking groove and is configured to engage the locking groove.

8. The dispenser of claim 7, wherein the locking hook has a substantially semi-circular form.

9. A refrigerating comprising the dispenser of claim 6.

10. A dispenser for a refrigerator, comprising:

a housing configured to be mounted on an outer surface of a refrigerator;

a drain pan configured to be slidably installed on the housing and configured to collect fluids therein; and a locking unit configured to secure the drain pan in place on the housing when the locking unit is engaged, and to release the drain pan from the housing when the locking unit is disengaged, wherein the locking unit comprises:

a first support rib which extends back from an upper portion of a through hole formed in the housing;

a second support rib which extends back from a rear portion of the drain pan and which is configured to pass through the through hole when the drain pan is slidably installed or removed;

a locking hook formed at an end portion of the second support rib; and a locking groove formed at an end portion of the first support rib and configured to engage the locking hook when the drain pan is installed, and to disengage the locking hook when the drain pan is removed.

11. The dispenser of claim 10, wherein the first support rib and the locking groove have an elastic quality and are configured to deform in response to a force applied by the second support rib and the locking hook.

12. The dispenser of claim 10, wherein the locking hook has a substantially semi-circular form which corresponds to a substantially semi-circular form of the locking groove.

13. A refrigerator comprising the dispenser of claim 10.

* * * * *